US009823684B2

(12) United States Patent
Finley et al.

(10) Patent No.: US 9,823,684 B2
(45) Date of Patent: Nov. 21, 2017

(54) LOCKABLE KNOB AND RELATED METHODS

(71) Applicants: Jason Finley, Modesto, CA (US); Matthew A. Taylor, San Leandro, CA (US)

(72) Inventors: Jason Finley, Modesto, CA (US); Matthew A. Taylor, San Leandro, CA (US)

( * ) Notice: Subject to any disclaimer, the term of this patent is extended or adjusted under 35 U.S.C. 154(b) by 106 days.

(21) Appl. No.: 14/750,808

(22) Filed: Jun. 25, 2015

(65) Prior Publication Data

US 2016/0378130 A1 Dec. 29, 2016

(51) Int. Cl.
*G05G 1/12* (2006.01)

(52) U.S. Cl.
CPC ..... *G05G 1/12* (2013.01)

(58) Field of Classification Search
CPC G05G 1/08; G05G 1/087; G05G 1/10; G05G 1/12; G05G 5/06; G05G 5/12; G05G 2700/06; G05G 2700/08
See application file for complete search history.

(56) References Cited

U.S. PATENT DOCUMENTS 2,797,591 A * 7/1957 Marrapese ..... G05G 1/02 126/42
3,342,082 A * 9/1967 Davidson ..... G05G 1/12 403/365
3,916,721 A 11/1975 Egger
3,954,019 A 5/1976 Ferguson
3,986,409 A * 10/1976 Tripp ..... G05G 1/02 188/83
4,026,397 A * 5/1977 Raus ..... F16D 11/14 192/114 R
4,036,079 A 7/1977 Pratt
4,084,675 A 4/1978 Smith et al.
4,253,690 A 3/1981 Hollander
4,347,758 A 9/1982 Geil et al.
4,373,405 A 2/1983 Geil
4,696,320 A 9/1987 Bull
4,779,305 A 10/1988 Gorsek
4,991,461 A 2/1991 Sennett et al.
5,152,187 A 10/1992 La Femina
5,159,706 A * 10/1992 Hodsdon ..... H04B 1/38 200/11 R
5,741,003 A * 4/1998 Segien, Jr. ..... F16K 31/60 16/441
8,434,199 B1 5/2013 Bowen et al.
9,384,920 B1 * 7/2016 Bakulich ..... H03J 5/10
(Continued)

FOREIGN PATENT DOCUMENTS

EP 0271982 12/1986

*Primary Examiner* — Adam D Rogers
(74) *Attorney, Agent, or Firm* — Buche & Associates, P.C.; John K. Buche; Bryce A. Johnson

(57) ABSTRACT

Lockable knobs for a rotary control of a device are described, wherein the control may be set at a specific setting via the knob without being susceptible to accidental disruption of the setting during use or transport of the device. Generally the device features: a spindle that is coupled to the rotary control via a set screw; a locking base with teeth that is stationary coupled adjacent to the spindle; and, a locking nut that may be positioned over the spindle, wherein the nut is configured to electively interact with the teeth of the base to prevent or allow rotation of the spindle.

7 Claims, 3 Drawing Sheets

(56) References Cited

U.S. PATENT DOCUMENTS

| | | | | |
|---|---|---|---|---|
| 2005/0098025 | A1 | 5/2005 | Fussell | |
| 2005/0173232 | A1 | 8/2005 | Horton et al. | |
| 2009/0205461 | A1 | 8/2009 | Windauer | |
| 2014/0165782 | A1 | 6/2014 | Windauer | |
| 2014/0237790 | A1 | 8/2014 | Messadek | |
| 2014/0311279 | A1* | 10/2014 | Toth | G05G 5/02 74/553 |
| 2015/0053043 | A1 | 2/2015 | Livolsi | |

* cited by examiner

LOCKABLE KNOB AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of Invention

The disclosed subject matter in this document is in the field of lockable knobs for rotary controls.

Background of the Invention

Rotary potentiometers are typically defined by a three-terminal electrical resistor that has a rotating contact. Rotating the relative position of the potentiometer changes an electric signal passed through the contact of the device. In operation, rotary potentiometers are commonly used to control electrical devices, like the volume or other effects controls on audio equipment.

To get a desired sound from audio equipment during a performance, musicians often meticulously set a precise position of multiple potentiometers on their various effects pedals and processors to exact settings. Frequently, these pre-set effects are engaged numerous times during the performance. Unfortunately, even small variations in the position of the potentiometer can adversely affect the sound of the audio equipment. Problems arise when potentiometers are not configured to be locked in position. Specifically, accidental positioning of the unlockable potentiometer settings can occur during use or transport of the equipment. For example, potentiometers of stringed musical instruments are often accidentally disrupted during use due to the close proximity of these controls to the strings. In view of this problem, many musician document the exact settings of their relevant potentiometers so that the same may be reset after an unintended disruption of potentiometer position settings.

Although sometimes adequate for getting desired sound from audio equipment, documenting potentiometer positions is undesirably tedious when a large number of effects and controls are involved. Furthermore, sometimes disturbed potentiometer positions go unnoticed until after an undesired sound is made by the audio equipment. Thus, a need exists for a lockable potentiometer knob for audio equipment that is not prone to accidental disruption during use or transport of the equipment.

At odds with the need for a lockable potentiometer for undesired movements, is the need for a manipulable potentiometer so that adjustments to the settings of the equipment may be made when desired. This need is particularly important when adjustments to potentiometer settings are to be made throughout a performance, e.g., to compensate for various changes in room acoustics, volume levels or any number of conditions that cannot be determined in advance. Thus, a desirable knob for potentiometers of audio equipment is lockable wherein disengaging the locking mechanism may be quickly accomplished to allow changes to the potentiometer settings. It is further desirable that the knob be readily re-lockable to retain the new settings against accidental disruption.

Other considerations for lockable potentiometers for audio equipment are pertinent. For instance, ambiguous visual markers for the position of the potentiometers are helpful during a musical performance so that scheduled or desired adjustments to potentiometer settings can be made quickly and without pause. For instance, if more volume is required, it is crucial to know the current setting in order to determine what adjustment to the volume controls is desirable or scheduled. Thus, a need further exists for lockable knobs for potentiometers with ambiguous visual position cues and wherein disengaging the locking mechanism may be quickly accomplished to allow changes to the potentiometer settings.

Other problems with potentiometer controls arise because audio equipment is manufactured by a variety of entities and in a variety of forms. This vast variety of manufacturing entities has led to an equally vast variety of control mechanisms for potentiometers. The vast variety in form of audio equipment controls has led to an equally vast variety of potentiometer control forms. In view of the foregoing, a control knob for a potentiometer would be universal to potentiometers regardless of manufacturing entity or audio equipment form. In other words, a desirable control knob for a potentiometer can be designed to be virtually unseen and retain the original appearance of the device it is fitted to if desired. Alternatively, a knob could can also be designed into audio equipment to eliminate the need to retrofit the individual pieces in place.

SUMMARY OF THE INVENTION

In view of the foregoing, it is an objective of this disclosure to describe lockable knobs for a rotary control of a device, wherein the control that may be set at a specific setting via the knob without being susceptible to accidental disruption of the setting during use or transport of the device. It is a further objective to describe knobs that are easily locked into a positions or settings while at the same time being easily unlocked for adjusting the knobs position. Yet still, it is an objective to describe a knob with ambiguous cues or markings of the knob's position or setting. Finally, it is an objective of this disclosure to describe a knob that may be fit or installed to many types or forms of audio equipment potentiometers without adversely affecting the appearance or function of the equipment.

In a preferred embodiment, the disclosed knobs may be used on various devices, including, but not limited to, guitars, bass guitars, keyboards, instrument effects pedals, amplifiers or any other devices featuring rotary potentiometers that require specific settings while being susceptible to accidental disruption during use and transport.

Other objectives and desires may become apparent to one of skill in the art after reading the below disclosure and viewing the associated figures. For instance, other devices featuring rotary controls exist that require specific settings while being susceptible to accidental disruption during use and transport.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

Generally disclosed are lockable knobs for a rotary control of a device, wherein the control may be set at a specific setting via the knob without being susceptible to accidental disruption of the setting during use or transport of the device. Generally the device features: a spindle that is coupled to the rotary control via a set screw; a locking base with teeth that is stationary coupled adjacent to the spindle; and, a locking nut that may be positioned over the spindle, wherein the nut is configured to electively interact with the teeth of the base to prevent or allow rotation of the spindle. The more specific features of the device are described with reference to the drawings.

Figure 1:
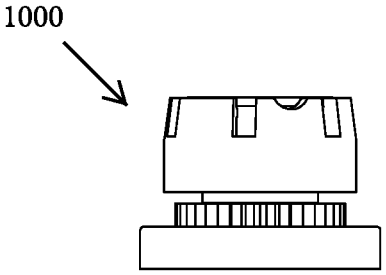
FIG. 1 is a front view of an embodiment of an unlocked knob 1000.
Figure 2:
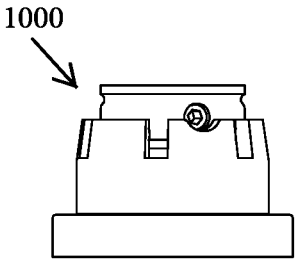
FIG. 2 is a front view of the knob 1000 of FIG. 1 in an unlocked configuration.
Figure 3:
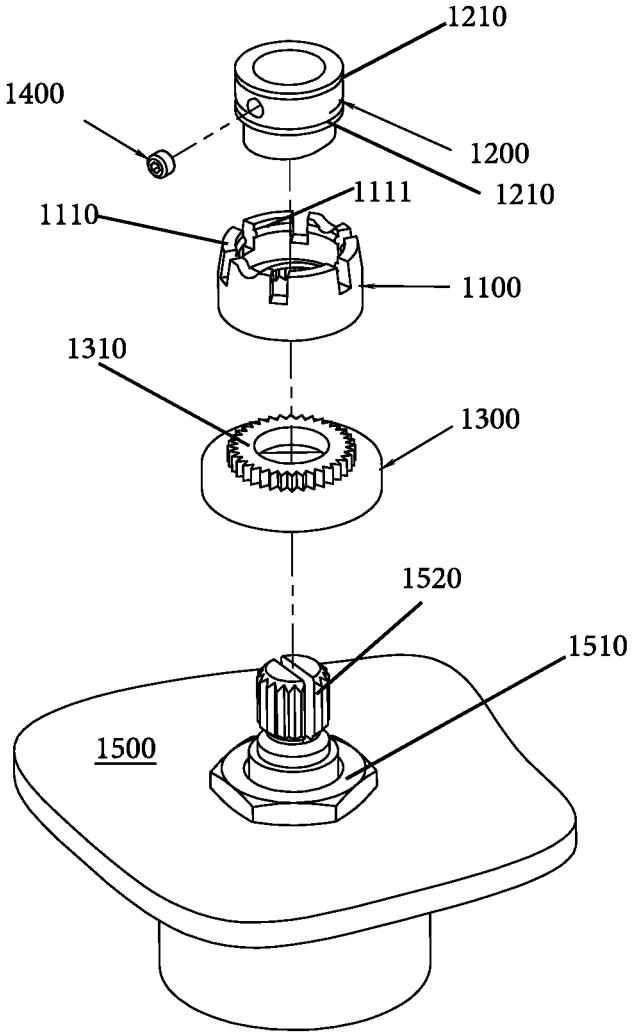
FIG. 3 is an exploded view of the knob 1000 of FIGS. 1 and 2.

FIG. 1 is a front view of an embodiment of an unlocked knob 1000. FIG. 2 is a front view of the knob 1000 of FIG. 1 in an unlocked configuration. FIG. 3 is an exploded view of the knob 1000 of FIGS. 1 and 2. As shown in FIG. 3, The knob 1000 is configured for use on a potentiometer 1500. Referring to FIGS. 1-3, the knob 1000 features: (1) a locking nut 1100; (2) a spindle 1200; (3) an anchor 1300; and (4) a set screw 1400.

In this embodiment of FIG. 3, the anchor 1300 may be positioned over the hexnut 1510 that is used to secure the potentiometer 1520 to a device 1500. When the anchor 1300 is so positioned, the potentiometer 1520 extends coaxially through the anchor 1300. Suitably, the anchor 1300 is a disk that has, on one side, a hex-shaped recess that receives the hexnut 1510 in a manner that does not allow the anchor (3) to rotate relative to the hexnut 1510. In a preferred embodiment, the anchor 1300 is configured to accept a broad range of hexnut sizes and snap into place firmly over the hexnut 1510. The other side of the anchor 1300 preferably features an upright cylinder 1310 with detents around its periphery.

Still referring to FIG. 3, the locking nut 1100 is a ring that is configured with digits 1110 that feature tongues 1111 on one side. On the other side (not shown), the locking nut 1100 is configured to receive the cylinder 1310 of the anchor 1300 within cooperating detents (not shown) in its inside diameter.

Yet still referring to FIG. 3, the spindle 1200 features two annular grooves 1210 respectively around the top and bottom of its head. The spindle 1200 is configured to receive the potentiometer 1520 through the locking nut 1100 whereby the locking nut 1100 is either (A) snap fit (e.g., via tongue and groove) to the upper annular groove 1210 of the spindle 1200 (see e.g., FIG. 2) or (B) snap fit to the lower annular groove 1210 of the spindle 1200 (see, e.g., FIG. 1). Finally, the set screw 1400 passes through the spindle 1200 so that the spindle 1200 is mechanically connected to the potentiometer 1520. Operably, when the locking nut 1100 is snap fit to the upper annular groove 1210 of the spindle 1200, it is floating over the anchor 1300 (see, e.g., FIG. 1), the knob is in an "unlocked position," and the spindle 1200 and nut 1100 may freely rotate to manipulate the potentiometer 1520. Conversely, in a "locked position," where the nut 1100 is snap fit into the lower annular groove 1210 of the spindle 1200, the potentiometer 1520 may not spin because the nut 1100 is locked to the anchor 1300 via interfacing detents.

Figure 4:
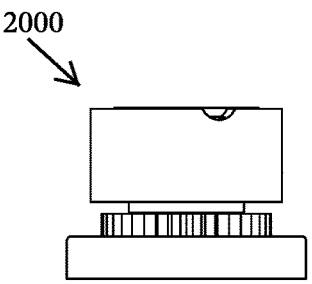
FIG. 4 is a front view of an embodiment of an unlocked knob 2000.
Figure 5:
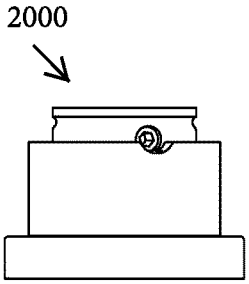
FIG. 5 is a front view of the knob 2000 of FIG. 4 in an unlocked configuration.
Figure 6:
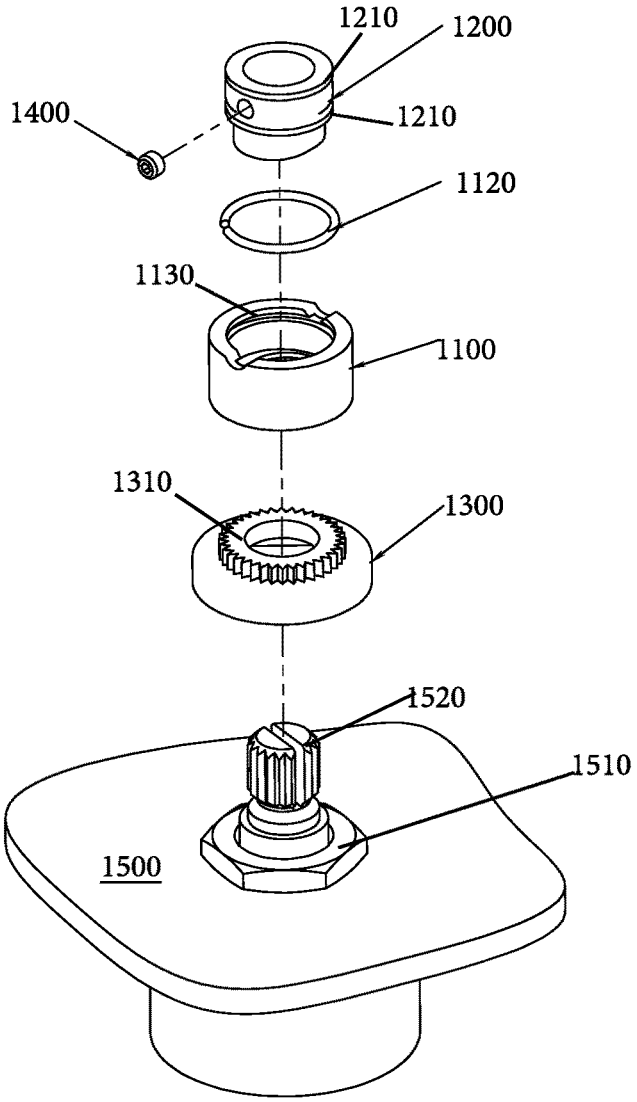
FIG. 6 is an exploded view of the knob 2000 of FIGS. 4 and 5.

FIG. 4 is a front view of an embodiment of another embodiment of an unlocked knob 2000. FIG. 5 is a front view of the knob 2000 of FIG. 4 in an unlocked configuration. FIG. 6 is an exploded view of the knob 2000 of FIGS. 4 and 5. As shown, the knob preferably features: (1) a ring spring 1120; (2) a set screw 1400; (3) an anchor 1300; (4) a locking nut 1100; and (5) a spindle 1200.

In this embodiment of FIG. 6, the anchor 1300 may be positioned over the hexnut 1510 that is used to secure the potentiometer 1520 to a device 1500. When the anchor 1300 is so positioned, the potentiometer 1520 extends coaxially through the anchor 1300. Suitably, the anchor 1300 is a disk that has, on one side, a hex-shaped recess (not shown) that receives the hexnut 1510 in a manner that does not allow the anchor (3) to rotate relative to the hexnut 1510. In a preferred embodiment, the anchor 1300 is configured to accept a broad range of hexnut sizes and snap into place firmly over the hexnut 1510. The other side of the anchor 1300 preferably features an upright cylinder 1310 with detents around its periphery.

Still referring to FIG. 6, the locking nut 1100 is a ring that suitably features a groove 1130 for receiving the ring spring 1120. The locking nut 1100 may be assembled over the spindle 1200 as described above in connection with the earlier embodiments. Suitably, the nut 1100 contains a ridge 1130 that accepts the ring spring 1120 and as the nut 1100 is moved upward or downward along the spindle 1200, the spring 1120 snap fits into one of the annular grooves 1210 of the spindle 1200. Operably, the nut 1100 may be pulled from a locked or unlocked position to engage or disengage the detented sections of the anchor 1300 and nut 1100 so that the spring 1200 is moved from each groove. On the other side (not shown), the locking nut 1100 is configured to receive the cylinder 1310 of the anchor 1300 within cooperating detents (not shown) in its inside diameter.

Yet still referring to FIG. 6, the spindle 1200 features two annular grooves 1210 respectively around the top and bottom of its head. The spindle 1200 is configured to receive the potentiometer 1520 through the locking nut 1100 whereby the locking nut 1100 and ring spring 1120 is either (A) snap fit (e.g., via tongue and groove) to the upper annular groove 1210 of the spindle 1200 (see e.g., FIG. 2) or (B) snap fit to the lower annular groove 1210 of the spindle 1200 (see, e.g., FIG. 1). Finally, the set screw 1400 passes through the spindle 1200 so that the spindle 1200 is mechanically connected to the potentiometer 1520. Operably, when the locking nut 1100 is snap fit to the upper annular groove 1210 of the spindle 1200, it is floating over the anchor 1300 (see, e.g., FIG. 1), the knob is in an "unlocked position," and the spindle 1200 and nut 1100 may freely rotate to manipulate the potentiometer 1520. Conversely, in a "locked position," where the nut 1100 is snap fit into the lower annular groove 1210 of the spindle 1200, the potentiometer 1520 may not spin because the nut 1100 is locked to the anchor 1300 via interfacing detents.

Figure 7:
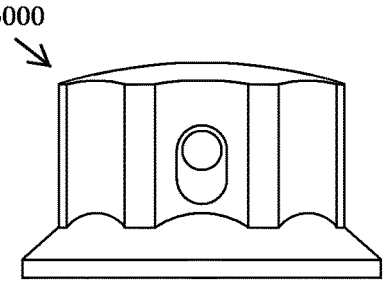
FIG. 7 is a front view of an embodiment of an unlocked knob 3000.
Figure 8:
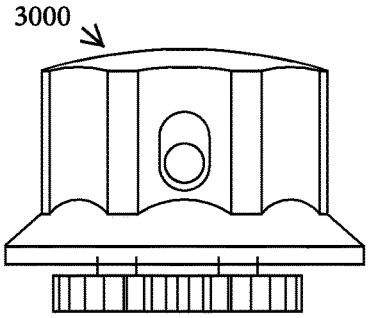
FIG. 8 is a front view of the knob 3000 of FIG. 1 in an unlocked configuration.
Figure 9:
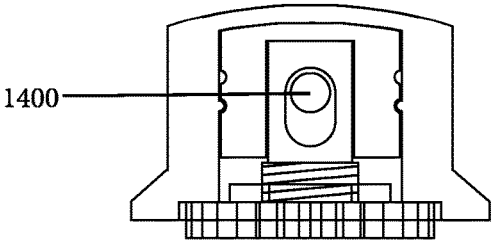
FIG. 9 is a cross section of the knob 3000 of FIG. 7.
Figure 10:
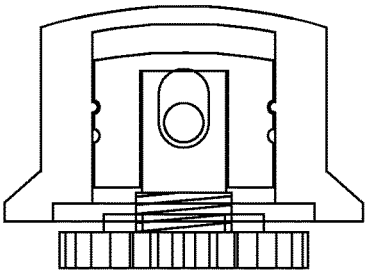
FIG. 10 is a cross section of the knob 3000 of FIG. 8.
Figure 11:
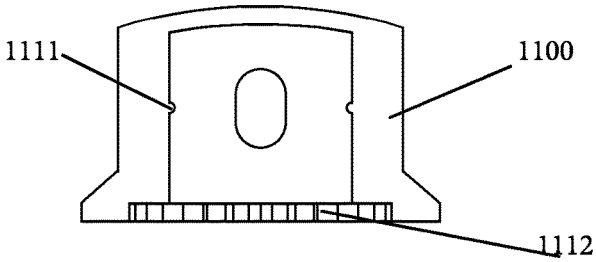
FIG. 11 is an exploded view of the knob 1000 of FIGS. 7 and 8; and, FIG. 12 is a perspective view of a generic disk with a hex-shaped recess.
Figure 11:
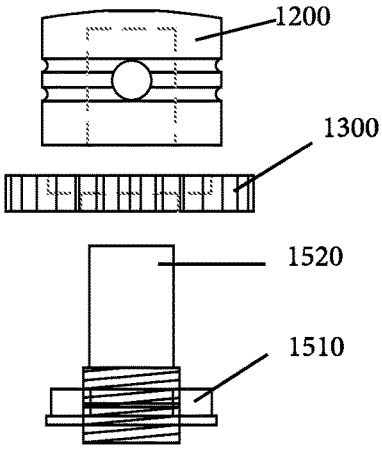
Figure 12:
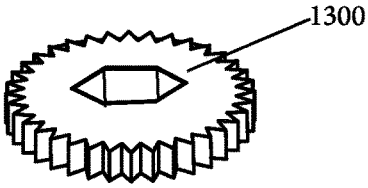

FIG. 7 is a front view of an embodiment of another unlocked knob 3000. FIG. 8 is a front view of the knob 3000 of FIG. 1 in an unlocked configuration. FIGS. 9 and 10 are FIG. 9 respective a cross sections of the knob 3000 of FIGS. 7 and 8. FIG. 11 is an exploded view of the knob 1000 of FIGS. 7 and 8. Referring to FIGS. 1-3, the knob 1000 features: (1) a locking nut 1100; (2) a spindle 1200; (3) an anchor 1300; and (4) a set screw 1400.

In this embodiment of FIGS. 7-11, the anchor 1300 may be positioned over the hexnut 1510 that is used to secure the potentiometer 1520 to a device (not shown). When the anchor 1300 is so positioned, the potentiometer 1520 extends coaxially through the anchor 1300 (see, e.g., FIGS. 9 and 10). Suitably, the anchor 1300 is a disk that has, on one side, a hex-shaped recess (shown in broken lines) that receives the hexnut 1510 in a manner that does not allow the anchor 1300 to rotate relative to the hexnut 1510. In a preferred embodiment, the anchor 1300 is configured to accept a broad range of hexnut sizes and snap into place firmly over the hexnut 1510. The other side of the anchor 1300 preferably features detents around its periphery.

Still referring to FIG. 11, the locking nut 1100 is hollow cap that is configured with a tongue 1111 around its interior. Preferably, the locking nut 1100 is configured to receive the cylinder 1310 of the anchor 1300 within cooperating detents 1112 in its inside diameter.

Yet still referring to FIG. 3, the spindle 1200 features two annular grooves 1210 respectively around the top and bottom of its head. The spindle 1200 is configured to receive the potentiometer 1520 through the locking nut 1100 whereby the locking nut 1100 is either (A) snap fit (e.g., via tongue and groove) to the upper annular groove 1210 of the spindle 1200 (see e.g., FIG. 10) or (B) snap fit to the lower annular groove 1210 of the spindle 1200 (see, e.g., FIG. 9). Finally, the set screw 1400 passes through the spindle 1200 so that the spindle 1200 is mechanically connected to the potentiometer 1520. Operably, when the locking nut 1100 is snap fit to the upper annular groove 1210 of the spindle 1200, it is floating over the anchor 1300 (see, e.g., FIG. 1), the knob is in an "unlocked position," and the spindle 1200 and nut 1100 may freely rotate to manipulate the potentiometer 1520. Conversely, in a "locked position," where the nut 1100 is snap fit into the lower annular groove 1210 of the spindle 1200, the potentiometer 1520 may not spin because the nut 1100 is locked to the anchor 1300 via interfacing detents.

In summary, the disclosed knob enables the selection of a position of a rotary potentiometer or other rotary control and easily locks said position in place to avoid accidental movement. In one embodiment, the knob is meant to be used on devices such as guitar/bass/instrument effects pedals, guitar/bass/keyboard instruments, instrument amplifiers, and any other musical instrument or device or any other device utilizing rotary potentiometers where specific settings are required by the user are prone to accidental movement during use and transport. In other embodiments, the knob may be used to benefit any person who uses a device with rotary potentiometers or other rotary control that requires the position of a single or multiple rotary controls to be set easily and retained at their preset position and easily disengaged to allow for easy adjustment and resetting as required.

The claims filed herewith are incorporated herein by reference in their entirety into the specification as if fully set forth herein.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

We claim:

1. A knob comprising:

a locking nut with a tongue and a recess, where the recess features detents that project inward relative to the recess;

a spindle with an upper groove and a lower groove, each configured for receiving the tongue of the locking nut;

an anchor with an upright cylinder that has detents, where the detents of the upright cylinder project outward relative to the upright cylinder, where said detents of the upright cylinder are configured to cooperatively interface with the detents of the recess of the locking nut;

a set screw;

wherein the anchor is configured to be positioned over a nut of a potentiometer; and wherein the potentiometer extends coaxially through the anchor and the anchor is a disk that has, on one side, a hex-shaped recess that receives the nut of the potentiometer in a manner that does not allow the anchor to rotate relative to the nut of the potentiometer.

2. The knob of claim 1 wherein the anchor is configured to accept a range of nut sizes and snap into place over the nut.

3. A knob comprising:

a locking nut with a tongue and a recess, where the recess features detents that project inward relative to the recess;

a spindle with an upper groove and a lower groove, each configured for receiving the tongue of the locking nut;

an anchor with an upright cylinder that has detents, where the detents of the upright cylinder project outward relative to the upright cylinder, where said detents of the upright cylinder are configured to cooperatively interface with the detents of the recess of the locking nut;

a set screw;

wherein the locking nut is a hollow cap that is configured with the tongue around its interior; and wherein the spindle is configured to receive a potentiometer through the locking nut whereby the locking nut is either (A) snap fit via a tongue-and-groove connection between the tongue and the upper groove of the spindle or (B) snap fit via a tongue-and-groove connection between the tongue and the lower groove of the spindle.

4. The knob of claim 3 wherein the set screw passes through the spindle so that the spindle is mechanically connected to the potentiometer.

5. The knob of claim 4 wherein the tongue is snap fit to the annular groove of the spindle so that the locking nut is floating over the anchor and the spindle and nut may freely rotate to manipulate the potentiometer.

6. The knob of claim 4 wherein the tongue is snap fit into the lower groove of the spindle so that the potentiometer may not spin because the locking nut is locked to the anchor via a cooperative interface between the detents of the upright cylinder and the detents of the recess.

7. A method of installing a knob on a potentiometer comprising the steps of:

positioning an anchor over a nut of the potentiometer, wherein the anchor features detents;

securing a spindle with an upper groove and lower grove to the potentiometer via a set screw; and placing a locking nut over the spindle so that a tongue of the locking nut is snap fit into the upper groove of the spindle.

* * * * *